United States Patent [19]

Autret et al.

[11] Patent Number: 4,461,213

[45] Date of Patent: Jul. 24, 1984

[54] LUMINOUS AUTODISPERSABLE PYROTECHNIC DEVICE

[75] Inventors: Lucien Autret, Saint-Sauveur; Jean-Philippe Godfrin, Plougastel Daoulas, both of France

[73] Assignee: Societe Nationale des Poudres et Explosifs, Paris, France

[21] Appl. No.: 439,031

[22] Filed: Nov. 3, 1982

[30] Foreign Application Priority Data

Nov. 10, 1981 [FR] France ..... 81 20996

[51] Int. Cl.[3] ..... F42B 4/02

[52] U.S. Cl. ..... 102/335; 102/285; 102/292; 149/2; 149/19.1; 149/42; 149/44; 149/85; 149/110; 149/113

[58] Field of Search ..... 102/335, 285, 292; 149/2, 19.1, 44, 42, 110, 113, 85

[56] References Cited

U.S. PATENT DOCUMENTS 4,216,722 8/1980 Angell ..... 102/491

*Primary Examiner*—Stephen J. Lechert, Jr.

*Attorney, Agent, or Firm*—Bucknam and Archer

[57] ABSTRACT

Pyrotechnic devices are described which are intended to emit an illuminating flux starting from multiple, exact, movable sources, particularly suitable for displays of artificial fireworks. The illuminating pyrotechnic devices consist of a shell which contains a block of a pyrotechnic composition consisting of at least a polymerized binder, an oxidizer and a combustible metal. For the purpose of achieving the bursting of the composition into a multitude of incandescent fragments when the device is ignited, the pyrotechnic composition consists of a binder of the phenoplastic type and an oxidizer, the granulometry of which is lower than 150 micrometers and the block, the smallest dimension of which is greater than 15 mm, has undergone a rapid cooling which gives rise to internal strains and fracture points within the composition.

17 Claims, No Drawings

LUMINOUS AUTODISPERSABLE PYROTECHNIC DEVICE

This invention relates to illuminating pyrotechnic devices which are intended to emit a luminous flux starting from multiple, exact, movable sources, and specifically during displays of fireworks. More specifically, the present invention deals with pyrotechnic devices which consist of a shell which contains a solid pyrotechnic composition prepared from at least a polymerized binder, an oxidizing substance and a combustible metal.

Pyrotechnic devices which have an external envelope which is incombustible or difficultly combustible, are used ordinarily, and for instance, the fires of Bengal frequently consist of a tube of thick carton in which the pyrotechnic illuminating composition, which totally adheres to the shell, is allowed to flow and solidify.

Some pyrotechnic compositions containing a polymerized binder are known, for instance from French Pat. No. 2 248 252 which describes this type of compositions which exhibit a high illuminating effectiveness and which utilize a binder which may be, for instance, a carboxyl substituted polybutadiene or a silicone binder. These compositions are intended to be shaped in the form of a cylinder in order to form signaling torches or illuminating fireworks which function for a long period of time because they burn in parallel layers, such as in the case of propellants, and the rate of combustion is low, in general, less than 2 mm per second.

An object of the present invention is to provide pyrotechnic devices, the composition of which bursts in a multitude of incandescent fragments after it has been ignited with the different fragments continuing to burn and to emit sparks with a vivid light which marks their aerial trajectories, the entire assembly constituting a very great star or a very great scintillating spray. The invention is further characterized by the fact that on one hand, the pyrotechnic composition consists of a binder of the phenoplastic type and an oxidizer, the granulometry of which is less than 150 micrometers, and on the other hand, the dimension of the block is greater than 15 mm, this block having undergone rapid cooling after polymerization, a fact which gives rise to internal strains and to fracture points within the composition itself.

According to one embodiment of the invention which facilitates the fragmentation of the pyrotechnic composition, this composition adheres only partially to the shell in such a manner that the ignition occurs not only on the free surface of the composition, but also in the areas where the composition does not adhere to the shell, a fact which causes the formation of local zones of lateral overpressure, which favor the bursting of the initial block of the composition into a multitude of fragments. According to the conventional embodiment, the shell is cylindrical and exhibits an internal diameter superior to 20 mm for the best compositions with great comminution, and superior to 30 mm for the compositions having a conventional comminution.

More particularly, the phenoplastic binder is a phenolic alkaline resin which polymerizes at a temperature higher than 140° C. In fact, it has been found during the course of experiments, that the resins which catalyze in an acidic medium and the resins of phenol-formaldehyde-resorcinol permit only with difficulty, the achievement of autodispersable compositions and require a thermal treatment which is much more substantial and much more difficult to reproduce. During the course of these experiments, it has been also discovered that at a temperature of polymerization lower than 140° C., the effect of autodispersion decreases considerably and this occurs to a greater extent the more the phenolic resin is very alkaline and very condensed, the condensation being in direct ratio to the length of the molecular chain of the prepolymer, and therefore, to the initial viscosity of this prepolymer.

Advantageously, the phenoplastic binder which is not polymerized exhibits a concentration lower than 60% and constitutes 25–45% of the total weight of the pyrotechnic composition. The concentration is the percentage of the solid products with respect to the solvent, this solvent being, in particular, water, alcohol or formaldehyde, and a concentration lower than 60% permits to achieve a decrease of the polymerization sufficient to produce the disengagement between the polymerized composition and the shell which partially surrounds this composition, a fact which facilitates the subsequent bursting of the block of the polymerized composition. The tests which have been carried out have permitted to establish that the proportions of the phenoplastic binder in the compositions have a direct effect on the fragmentation of the polymerized block at the time when the composition is ignited. It has been observed, on one hand, that at a concentration less than 25% binder, the greatest part of the compositions does not explode, the same when the concentration is less than 50% and the rate of cooling has increased, and on the other hand, above 45% of binder, the expansion during the course of the polymerization is such that deep cracks are likely to appear in the composition, a fact which diminishes the mechanical resistance and decreases the possibility of transportation or storage.

More particularly, the phenoplastic binder is combined with an oxidizer which is selected from the group of alkaline perchlorates, and more specifically potassium perchlorate, which is introduced in the proportions of between 40% and 60% of the total weight of the composition. The granulometry of the oxidizer is one of the essential parameters which permit the adjustment of the effect of the explosion and essentially the granulometry is less than 100 micrometers and even lower than 70 micrometers when the cooling of the composition is not sufficiently rapid or when one wishes to obtain blocks of diameter lower than 50 mm.

More particularly, the phenoplastic binder is combined with a combustible metal which consists of 10% to 30% weight of the pyrotechnic composition, and the combustible metal may consist of an aluminum which has been passivated, such as aluminum which has been oxidized or chromated on the surface.

Advantageously, the pyrotechnic composition is polymerized within the external shell, but it is then desirable that the binder be an alkaline phenolic resin, the temperature of polymerization of which is higher than 140° C. and this external shell consists advantageously of a cylindrical tube provided with a bottom. According to another embodiment of the invention, cylindrical blocks of the polymerized composition may be placed within the external shells, but it is then advantageous that on one hand, there is provided for at least a space of some tenths of millimeters and on the other hand, that there is a discontinuous adhesion between this block and the shell in such a manner as to achieve zones of lateral ignition, and the zones of non-adhesion must be more pronounced on the surface as much as the smallest dimension of the block is small.

According to an essential requirement of the invention, after the delay in the polymerization of the binder which is carried out in an oven, the pyrotechnic device must be placed immediately in the free air, and the different devices should be sufficiently separated one from the other so that the thermal interactions are negligible. The internal strains and the fracture points constituted by microfissures, which determine a tridimensional network of cracks, may be increased either by choosing an alkaline phenolic resin which polymerizes at a higher temperature or by carrying out a more rapid cooling after the polymerization, for instance by placing the pyrotechnic devices in a current of air at room temperature or by placing the devices in cells which are made in metallic plates which are partially immersed in a refrigerating liquid.

The advantages obtained according to the invention reside essentially in the distribution of the illuminating source in a very great volume. This distribution may be notably utilized within the design of an exhibit of fireworks in order to constitute very great "conflagrations" which take the form of illuminating fountains because each fragment of the initial block emits multiple stars which remain lit for a few seconds or a few fractions of seconds and this also marks the track of these fragments. This distribution of the illuminating source in a very great volume may be useful equally for an intense illumination of short duration, generally less than five seconds, which reduces the resulting shadows and certain applications may be carried out for the purpose of illuminating monuments or sites within the scope of an exhibit "sound and light" utilizing fireworks as well as the temporary illumination of "battle-fields".

Some of the preferred embodiments within the scope of the present invention are described hereinbelow.

The best characteristics with respect to the explosion and autodispersion have been obtained with compositions of the following type: a phenolic resin, a perchlorate of an alkali metal which is combustible when one utilizes, on one hand, a phenolic resin which is slightly alkaline, which solidifies above 140° C., and on the other hand, when the solidified composition is rapidly brought back to room temperature. The work which has been carried out has permitted to select the other constituents which are the most appropriate and to determine their respective proportions and the best results with respect to the distribution and the intensity of the illuminating source have been obtained by utilizing potassium perchlorate and aluminum which has been passivated, the ranges by weight being the following:

25–45% of a phenolic resin which is slightly alkaline and which is moderately condensed, which resin hardens at a temperature higher than 160° C., 40–60% of potassium perchlorate, 10–30% of oxidized aluminum, and the relative proportions of the constituents are defined by the following:

$$20\% < \frac{Al}{KClO_4} < 60\%, \text{ and } 30\% < \frac{Al}{resin} < 80\%$$

With respect to the manufacture of the pyrotechnic devices according to the present invention, it should be noted that the composition which is not polymerized has the appearance of a flowing liquid, which is more or less dense or has the appearance of a soft injectable paste which offers a great safety in the manufacture because the fluid composition is difficultly inflammable, and it is not necessary to provide for substantial removal of the solvent. In addition, within the scope of the compositions which constitute the preferred embodiments, all the compositions are flowable and do not require, for the great part, more than a cooling in the free air after the polymerization in an oven, the utilization of pulsating air or cooling vats, nevertheless, being necessary for compositions which are close to the preferential embodiments.

According to the preferred embodiment of the invention, one disregards the phenoplastic binders which are catalyzed in an acidic medium because these binders lead to a dispersion which is very reduced and not instantaneous, with the pyrotechnic devices having a tendency to behave more as an illuminating fountain having an irregular frontal combustion, rather than as an autodispersable block.

In addition, the utilization of an acidic catalytic system requires utilization of the aluminum in a form which is rigorously passivated in order to avoid the attack by acids and the development of hydrogen, which increases the expansion at the time of the polymerization, interferes with an homogenous and reproducible polymerization. The phenolic resin which is marketed by the French company CDF-CHIMIE, under the symbol 1221, constitutes an example of a binder with which it is very difficult to achieve a satisfactory realization of the invention.

According to the preferred embodiment of the invention, one also disregards the phenolic resins which are very alkaline and in a high state of condensation and which harden spontaneously at a temperature of 120° C. because these resins, for example the resin marketed by the company HOECHST under the symbol PHENODUR PW 799, cause a substantial expansion of the paste in the course of polymerization, but the pyrotechnic device so obtained fragmentizes only partially and irregularly, particularly when rapid cooling does not occur until the material is exposed to the air.

According to the preferred embodiment of the invention, one of the resins which permits to achieve the best results is the resin marketed by the company HOECHST, under the symbol PHENODUR PW 759. This is a resin which utilizes water as the solvent, a fact particularly advantageous within the scope of the invention with respect to safety, which hardens spontaneously in the course of one hour at 170° C., it is slightly alkaline, has a 50% concentration and it is weakly condensed. However, it should be noted that unpolished aluminum is slightly attacked by this resin and, therefore, it is preferable to utilize aluminum which has been passivated for the purpose of obtaining a luminous effect which is more spectacular. The nature, the amount and the quality of the combustible metal being utilized are essentially determined by the luminous effect which is desired and, for instance, choosing as basic, an amount of 13% of a fine aluminum which is oxidized on the surface combined with potassium perchlorate of a granulometry of 40 μm and the resin HOECHST, PW 759, the examples hereinbelow illustrate several embodiments:

| EXAMPLES | 1 | 2 | 3 | 4 | 5 |
|---|---|---|---|---|---|
| Resin PW 759 | 44 | 37 | 33 | 30 | 27 |

-continued

| EXAMPLES | 1 | 2 | 3 | 4 | 5 |
|---|---|---|---|---|---|
| $KClO_4$ | 43 | 50 | 54 | 57 | 60 |
| Al | 13 | 13 | 13 | 13 | 13 |

The tests have been carried out by letting the compositions shown in the examples flow into tubes made of cardboard of 1.5 mm thickness provided with a bottom equally made of cardboard, the internal diameter of which is 34 mm and the height is 50 mm, the weight of the composition being 45 grams per tube, which corresponds to an initial filling essentially equal to ¾ of the internal volume of the tubes. After polymerization in an oven at a temperature of 170° C. for a period of one hour, the pyrotechnic devices are removed from the oven and are allowed to go rapidly from 170° C. to 18° C. in an environment where they are exposed to the air, the pyrotechnic devices being spaced one from the other by 25 cm and being arranged on the same plane.

This rapid cooling, which follows the expansion of the resin during the course of the polymerization, creates strains within the block which is being shrunk and this effect causes two reactions: on one hand, the block of the composition is partially removed from the walls of some tenths of millimeters, thus avoiding inhibition of the block by the carton of the tube, and on the other hand, the block of the composition is cracked in an aleatory manner so that a sort of tridimensional network is created which favors the separation into fragments at the time of ignition. The expansion during the course of the polymerization is very important because it is possible to achieve ¼ of the initial volume when the contraction due to the cooling is much weaker. However, it is the phase of cooling which is essential in order to achieve the explosion of the block and the conditions of cooling must be adjusted in order to optimize the effect desired, the initial rate of explosion being more or less close to an internal explosion caused by the very great surface of the initial combustion presented by the internal cracks and the zones of the carton which have been removed, a fact which assures the initial pressure and determines the explosion of the composition block. This phenomenon of explosion depends equally on the granulometry of the oxidizer and on the smallest dimension of the block, the explosion being favored by fine granulometry, lower than 70 micrometers and by the increase of the smallest dimension, if possible more than 25 mm.

The ignition of the pyrotechnic devices is carried out by means of a simple priming wick in contact with the free surface of the cylindrical block of the composition, but every other means of ignition being used currently by the firework-makers may be utilized, for instance a relay charge, a primer or a pyrotechnic delay.

The ignition of the pyrotechnic devices of Examples 2, 3 and 4 determines real, instantaneous explosions which project themselves over a radius of 40 meters in the form of small, incandescent, very bright fragments. The number of the fragments and the direction of the projections are aleatory but there are produced some compensation effects between thousands of ejected fragments and the effects, as a whole, are very reproducible. Each incandescent fragment is accompanied by a track of stars which remain lit for a few seconds and the combustion of the fragments of largest size may achieve five seconds.

The manufacture of the pyrotechnic device No. 1 involves a too great expansion during the course of the polymerization which leads to less good mechanical properties, followed by the pyrotechnic devices according to Example 5, with which the cooling in the free air is not suitable because the block burns with strong projections of the incandescent elements, a fact which involves an appreciable, aesthetic effect, but the device does not explode in a manner which is significant and reproducible.

The utilization of a greater amount of the combustible metal is possible still within the scope of the preferred embodiment of the present invention and compositions with 25% of passivated aluminum have been prepared. A composition such as the composition containing 33% of Resin PW 759, 42% of potassium perchlorate (40μ) and 25% of aluminum oxide, gives complete satisfaction and explodes instantaneously when it is ignited when the blocks have a diameter of 30 mm or 50 mm. On the other hand, it has been observed that a block of diameter of 12 mm could not explode, in spite of several experiments carried out in lowering the degree of granulometry of the perchlorate, adopting a resistant shell or tempering the blocks exiting from the oven after polymerization. The amount of the resin may be lowered up to 25% but with an amount lower than 30%, the viscosity starts being important in order to maintain the process of filling the external tubular shells by letting the composition flow into them and the process of injection then becomes desirable, although the presence of bubbles in the composition or between the composition and the shells may constitute a great drawback.

The illuminating pyrotechnic devices according to the invention, may be surrounded by a resistant tube which transforms the multidirectional explosion into a controlled jet, the incandescent fragments of which and the generators of the durable sparks are projected at a great distance.

What is claimed is:

1. An illuminating pyrotechnic device consisting of a shell containing a block of pyrotechnic composition consisting of at least one polymerized binder, an oxidizer and a combustible metal, wherein the pyrotechnic composition is prepared from a binder of the phenoplastic type and an oxidizer, the granulometry of which is lower than 150 micrometers, and the smallest dimension of the block is greater than 15 mm, the block having undergone a rapid cooling after polymerization whereby internal strains are created and fracture points are formed within the composition, so that said composition explodes immediately after the pyrotechnic device is ignited.

2. The pyrotechnic device according to claim 1, wherein the pyrotechnic composition adheres only partially to the shell.

3. The pyrotechnic composition according to claim 1, wherein the shell is cylindrical and presents an internal diameter greater than 20 mm.

4. The pyrotechnic composition according to claim 1, wherein the phenoplastic binder is a phenolic resin.

5. The pyrotechnic composition according to claim 4, wherein the phenolic resin polymerizes at a temperature higher than 140° C.

6. The pyrotechnic composition according to claim 4, wherein the phenolic resin is an alkaline resin.

7. The pyrotechnic composition according to claim 1, wherein the phenoplastic binder which is not polymerized has a concentration less than 60%.

8. The pyrotechnic device according to claim 1, wherein the phenoplastic binder is in the amount of 25–45% of the total weight of the pyrotechnic composition which has not been polymerized.

9. The pyrotechnic device according to claim 1, wherein the phenoplastic binder is combined with an oxidizer which is an alkali metal perchlorate.

10. The pyrotechnic composition according to claim 1, wherein the oxidizer has a granulometry lower than 100 micrometers.

11. The pyrotechnic composition according to claim 9, wherein the alkali metal perchlorate is potassium perchlorate, which is present in the proportion between 40 and 60% by weight of the total weight of the composition.

12. The pyrotechnic device according to claim 10, wherein potassium perchlorate has a granulometry lower than 70 micrometers.

13. The pyrotechnic device according to claim 1, wherein the phenoplastic binder is combined with a combustible metal which is present in the amount of 10–30% by weight of the total weight of the composition.

14. The pyrotechnic composition according to claim 1, wherein the combustible metal is passivated aluminum.

15. The pyrotechnic composition according to claim 2, wherein the pyrotechnic composition is polymerized within the external shell.

16. The pyrotechnic device according to claim 1, wherein the shell consists of a cylindrical tube provided with a bottom.

17. The pyrotechnic device according to claim 1, wherein after the delay in the polymerization of the binder which is carried out in the oven, the device is immediately placed in free air.

* * * * *